US005107865A

United States Patent [19]

Case et al.

[11] Patent Number: 5,107,865

[45] Date of Patent: * Apr. 28, 1992

[54] SMOKING ARTICLES

[75] Inventors: Paul D. Case; John A. Luke, both of Southampton, Great Britain

[73] Assignee: Brown & Williamson Tobacco Corporation, Louisville, Ky.

[ * ] Notice: The portion of the term of this patent subsequent to Mar. 27, 2007 has been disclaimed.

[21] Appl. No.: 576,817

[22] Filed: Sep. 4, 1990

Related U.S. Application Data

[60] Continuation of Ser. No. 390,316, Aug. 7, 1989, which is a division of Ser. No. 239,914, Sep. 2, 1988, Pat. No. 4,911,184.

[30] Foreign Application Priority Data

Sep. 3, 1987 [GB] United Kingdom ..... 8720726

[51] Int. Cl.[5] ..... A24D 1/02

[52] U.S. Cl. ..... 131/365; 131/361

[58] Field of Search ..... 131/365, 361

[56] References Cited

U.S. PATENT DOCUMENTS

| | | | |
|---|---|---|---|
| Re. 32,615 | 3/1988 | Luke | 131/361 |
| 4,622,983 | 11/1986 | Mathews et al. | 131/365 |
| 4,911,184 | 3/1990 | Case et al. | 131/365 |

*Primary Examiner*—V. Millin
*Assistant Examiner*—Lynne A. Reichard
*Attorney, Agent, or Firm*—Charles I. Sherman

[57] ABSTRACT

Low sidestream cigarettes comprise cigarette rods not exceeding 20 mm in circumference. The cigarette rods comprise paper wrappers of a type which effect a sidestream reduction of at least 30% when used on rods of conventional dimensions.

16 Claims, 2 Drawing Sheets

Figure 1:
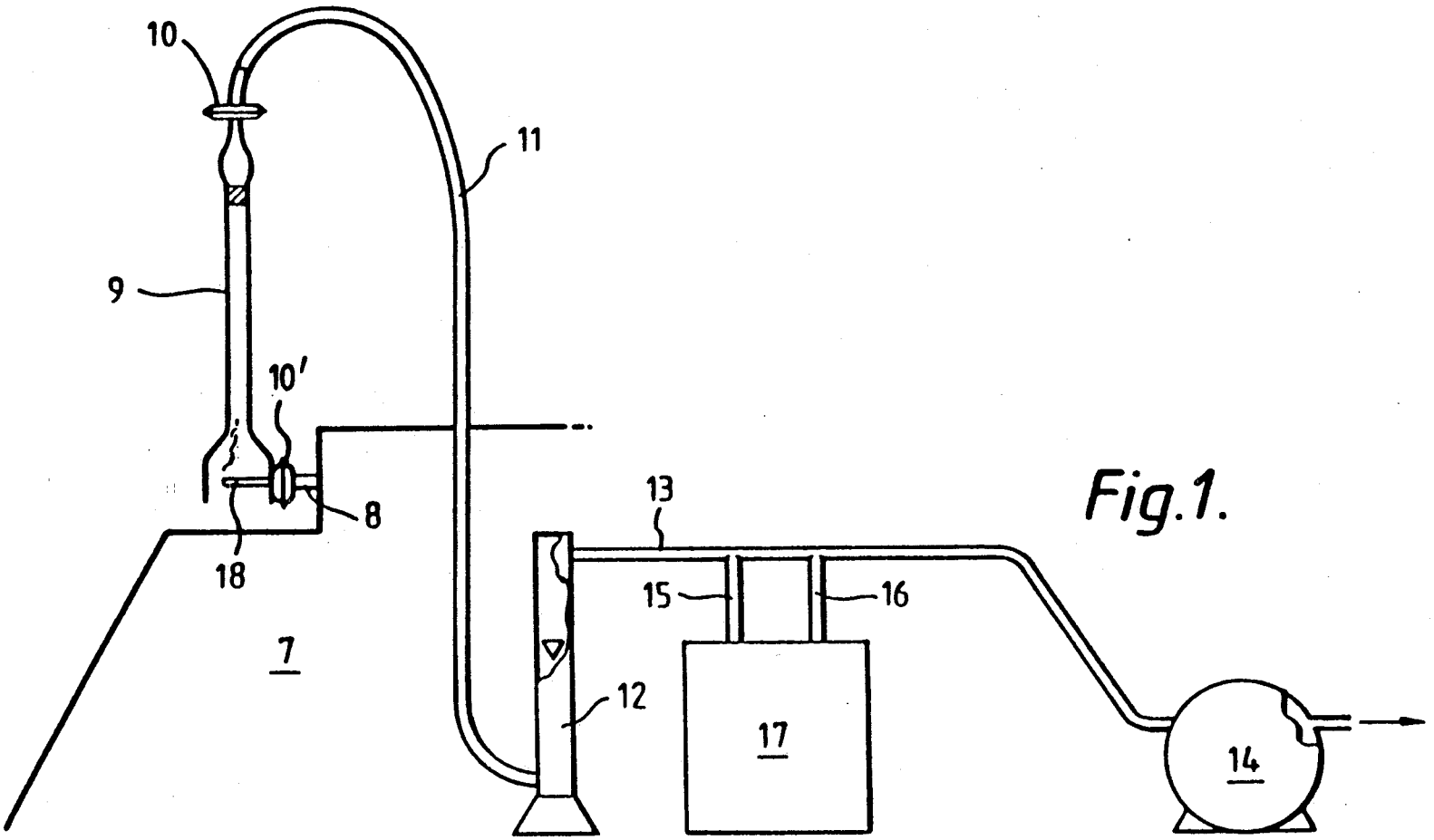

Fig. 2.
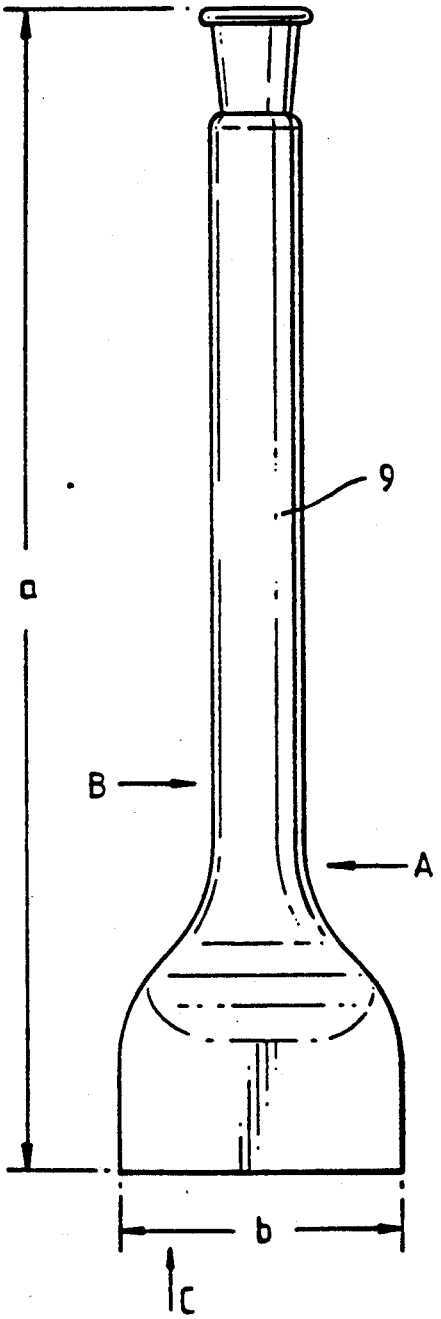
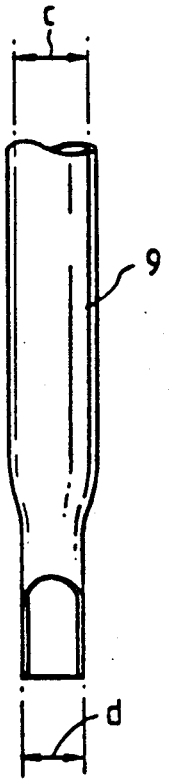
Fig. 3.
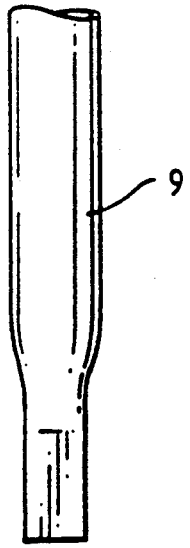
Fig. 4.
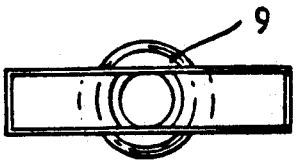
Fig. 5.

SMOKING ARTICLES

This is a continuation of copending application Ser. No. 07/390,316 filed on Aug. 7, 1989, which is a division of Ser. No. 07/239,914, filed Sep. 2, 1988, now U.S. Pat. No. 4,911,184.

The invention the subject of this application relates to cigarettes and similar smoking articles.

In United Kingdom Patent Specification No. 2 175 789A there is a disclosure to the effect that cigarettes having a circumference within a range of 10 mm to 19 mm and a free burn rate of the cigarette rod of 25 to 50 mg $min^{-1}$ exhibit lower smoke component sidestream deliveries than do comparable conventional cigarettes.

There are disclosed in United Kingdom Patent Specification No. 2 094 130A cigarettes comprising cigarette papers having air permeabilities due to viscous flow of not more than 3 Coresta Units and Do/t ratios in a range of 0.08 to 0.65 cm $sec^{-1}$, where Do signifies the coefficient of diffusion of oxygen through nitrogen in the paper and t signifies the thickness of the cigarette paper. Such cigarettes exhibit low deliveries of total particulate matter and nicotine in the sidestream smoke.

A further approach to the obtainmemt of low component deliveries in the sidestream smoke of cigarettes is by way of using cigarette papers comprising one or more sidestream reducing compounds. Thus, for example, there is a teaching in United Kingdom Patent Specification No. 2 139 869A that the total particulate matter in the sidestream smoke emanating from the lit end of a cigarette during the smoking thereof can be reduced by at least 30% if the cigarette paper comprises one or more, preferably a plurality, of compounds of the group consisting of lithium hydroxide, aluminium hydroxide, calcium hydroxide, potassium formate, sodium formate and sodium acetate.

Another example of the use of sidestream reducing compounds is disclosed in U.S. Pat. No. 4,231,377, according to the teaching of which magnesium oxide and an adjuvant salt are incorporated in combination in cigarette paper.

It is an object of the subject invention to provide an improved low sidestream cigarette or similar smoking article.

The subject invention provides a smoking article comprising a smoking material rod, which rod comprises smoking material and a wrapper circumscribing said smoking material, said rod not exceeding 20 mm in circumference and said wrapper being of a material comprising a sidestream reducing compound, said material being such that when providing a wrapper of a smoking material rod of conventional cigarette circumference there is effected a reduction of at least 30% in the particulate matter, on a water and nicotine free basis, of sidestream smoke compared with a control rod of the same conventional cigarette circumference and comprising conventional cigarette paper.

The sidestream reducing compound is effective to reduce visible sidestream smoke components without effecting a marked, if any, reduction in gas phase components of sidestream smoke. Among the compounds which can be used, singly or in combination, as sidestream reducing compounds are aluminium hydroxide, calcium hydroxide, lithium hydroxide, magnesium hydroxide, magnesium oxide, alumina and Attapulgite clay. Other compounds which can be used as sidestream reducing compounds are disclosed in U.S. Pat. No. 4,461,311, to which reference is directed.

Suitably, the material of wrappers of smoking articles according to the present invention is paper. Water insoluble sidestream reducing compounds may be added in powder form as a filler to the paper furnish during the making process of paper wrapper material. Water soluable sidestream reducing compounds are preferably applied to the wrapper material in aqueous solution.

The smoking material of smoking articles according to the subject invention preferably comprises or consists of cut tobacco, a proportion of which tobacco may be expanded tobacco. The smoking material may comprise reconstituted tobacco or tobacco substitute material.

The length of the smoking material rod is advantageously at least 60 mm and the rod should preferably yield not less than six puffs, and more preferably not less than seven puffs when smoked under standard machine smoking conditions. The rod is preferably of uniform cross-sectional shape and dimensions throughout the length of the rod. If the rod is of circular cross-sectional, the circumference of the rod may be as low as 10 mm for example, but is preferably not less than 12.5 mm.

Advantageously, the circumference of the smoking material rod does not exceed about 19 mm and more advantageously it may be less than 18 mm.

Preferably, cigarettes according to the subject invention comprise filter or mouthpiece means attached to the smoking material rod at one end thereof.

Preferably, wrappers of smoking articles according to the present invention are of a low permeability, the permeability thereof being, for example, not more than 20 Coresta Units, and more preferably not more than 12 Coresta Units.

In order to further the understanding of the present invention, examples according thereto will now be described.

EXAMPLE I

There was produced a cigarette consisting of a 20 mm circumference cigarette rod of 64 mm length and a cellulose acetate filter of 20 mm length attached to the rod by means of a tipping wrapper. The rod comprised a cut tobacco filler having a density of 240 mg $cm^{-3}$, which filler was wrapper in a circumscribing cigarette paper wrapper of 19 Coresta Units permeability and a substance of 45gm $m^{-2}$. The cigarette paper wrapper comprised 23% chalk, 8% magnesium hydroxide and 2% sodium acetate. When these cigarettes were smoked under standard machine smoking conditions, i.e. a 35 $cm^3$ puff of 2 seconds duration every minute, to a cigarette rod butt 8 mm long, the total yield of sidestream particulate matter, on a water and nicotine free basis, was 9.2 mg, the total yield of sidestream carbon monoxide being 34.3 mg. The number of puffs during smoking was 8.9.

EXAMPLE II

Cigarettes were produced consisting of 20 mm circumference, 64 mm long cigarette rods and 20 mm long cellulose acetate filters attached to the rods by tipping wrappers. The cigarette rods comprised a cut tobacco filler of a density of 287 mg $cm^{-3}$ and cigarette paper wrappers of 11 Coresta Units permeability and a substance of 43 $gm^{-2}$. The cigarette paper wrapper comprised 19.7% chalk, 5.0% magnesium oxide and 6.7% citrate tri-potassium (expressed as % anhydrous citric acid). These cigarettes, smoked under standard machine smoking conditions, produced a total yield of sidestream particulate matter, water and nicotine free, 13.3 mg and a total yield if sidestream carbon monoxide of 36.8 mg. The cigarettes yielded 8.3 puffs.

EXAMPLE III

Cigarettes were produced consisting of 17 mm circumference, 70 mm long cigarette rods and 27 mm long cellulose acetate filters. The density of the cut tobacco filler of the cigarette rods was 293 mg $cm^{-3}$. The cigarette rod wrappers were of cigarette paper of 26 Coresta Units permeability and a substance of 26 g $m^{-2}$. The paper did not contain sidestream reducing compounds. Some of these cigarettes were overwrapped with a second cigarette paper, which second paper was of 15 Coresta Units permeability and of a basis weight of 50 g $m^{-2}$. The second paper comprised 4.5% chalk, 24.3% magnesium hydroxide and 3.6% sodium acetate.

When the overwrapped cigarettes were smoked under standard smoking conditions it was determined that each produced a total yield of sidestream particulate matter, water and nicotine free, of 8.3 mg and total yields of sidestream carbon monoxide and nicotine of 39.1 mg and 1.1 mg respectively. The puff number of the overwrapped cigarettes was 12. When the non-overwrapped cigarettes were smoked under the same conditions, the total yields of sidestream particulate matter, water and nicotine free, carbon monoxide and nicotine were 20.7 mg, 45 mg and 2.7 mg respectively.

Two types of control cigarette were smoked, each having a 64 mm long cigarette rod of a conventional 24.75 mm circumference. The first type of control cigarette comprised a conventional cigarette paper wrapper of 47 Coresta Units permeability, a substance of 25 $gm^{-2}$, the wrapper comprising 26% chalk and 0.8% tri-potassium citrate. When the first type of control cigarette was smoked under standard smoking conditions, it was found to deliver a total yield of sidestream nicotine of 4.9 mg. As noted above, the total sidestream nicotine delivery for the non-overwrapped 17 mm cigarettes was 2.7 mg. It may thus be observed that with the cigarettes comprising conventional cigarette paper wrappers, a reduction of cigarette rod circumference to an unconventional 17 mm, from a conventional 24.75 mm, reduces the sidestream nicotine by 45%.

The second type of control cigarette comprised a cigarette paper wrapper of the same type of paper as used to overwrap the above mentioned overwrapped 17 mm cigarettes. When the second type of control cigarette was smoked under standard smoking conditions, it was found to deliver a total yield of sidestream nicotine of 2.5 mg. When this sidestream nicotine yield is compared with that of the first type of control cigarette, it may be observed that the substitution of the sidestream reducing cigarette paper for the conventional cigarette paper of the first type of control cigarette effects a 49% reduction in sidestream nicotine yield.

From the above it would be expected that by combining in a single cigarette the two sidestream nicotine reducing features, namely a reduction in cigarette circumference from 24.75 mm, to 17 mm. and the substitution of a conventional cigarette paper by a sidestream reducing cigarette paper, that the total sidestream nicotine yield would be reduced to 28% of that of a conventional cigarette comprising neither of the features, which conventional cigarette is represented by the first type of control cigarette. In point of fact though, the 17 mm circumference overwrapped cigarettes, which, of course, do comprise each of the two sidestream reducing features, effect a reduction in total sidestream nicotine yield to a value, namely 1.1 mg, which is 22.5% of that of the first type of control cigarette. Thus the overwrapped 17 mm circumference cigarettes exhibited a synergistic sidestream nicotine reduction effect.

EXAMPLE IV

Cigarettes were produced consisting of 24.75 mm circumference, 64 mm long cigarette rods and 20 mm long cellulose acetate filters. The density of the cut tobacco filler of the cigarette rods was 279 mg $cm^{-3}$. The cigarette rod wrappers were of a conventional cigarette paper of 47 Coresta Units permeability and a substance of 25 g $m^{-2}$. The paper comprised 26% calcium carbonate filler and 0.81% of burn additive consisting of a mixture of potassium citrate and sodium citrate, expressed as percentage citric acid. These cigarettes were designated Cigarettes A.

Second cigarettes, designated Cigarettes B, were produced, the Cigarettes B being in all particulars the same as the Cigarettes A excepting that the cigarette rod wrappers of the Cigarettes B were of a sidestream reducing paper of 19 Coresta Units permeability and a substance of 44.8 g $m^{-2}$. The sidestream reducing paper comprised 8.2% magnesium hydroxide, 21.8% calcium carbonate and 2.02% sodium acetate.

Cigarettes C were produced, which cigarettes were the same as Cigarettes A in all particulars excepting that the Cigarettes C were of a circumference of 17 mm.

Cigarettes D were produced, which cigarettes were the same as Cigarettes C in all particulars excepting that the cigarette rod wrappers of the Cigarettes D were of the same paper as that of the cigarette rod wrappers of the Cigarettes B. Cigarettes D were cigarettes in accordance with the subject invention.

The Cigarettes A–D were smoked under standard machine smoking conditions and measurements were made of the total sidestream yields per cigarette of particulate matter, on a water and nicotine free basis (PMWNF), total nicotine alkaloids (TNA) and carbon monoxide (CO). The measured values are given in Table 1.

The predicted values shown in Table 1 for Cigarettes D were calculated from the measured values for Cigarettes A–C. Thus, for example, the predicted value of PMWNF for Cigarettes D is calculated as—

$$18.5 \text{ mg} \times \frac{15.8}{36.5} = 8 \text{ mg}$$

The measured value of PMWNF for Cigarettes D was 7.0 mg. It is thus seen that in both reducing the diameter of a cigarette and providing a sidestream reducing wrapper therefor in accordance with the subject invention there is effected a synergistic reduction in sidestream PMWNF. As Table 1 also shows, Cigarettes D in accordance with the subject invention also exhibit synergistic reductions in sidestream TNA and CO.

The average puff number of Cigarettes D was 10.8.

TABLE 1

| Cigarette | PMWNF mg | TNA mg | CO mg |
|---|---|---|---|
| A | 36.5 | 7.72 | 62.1 |
| B | 15.8 | 5.43 | 60.1 |
| C | 18.5 | 3.29 | 42.4 |
| D | 8.0 | 2.30 | 41.1 |
| Predicted | | | |

TABLE 1-continued

| Cigarette | PMWNF mg | TNA mg | CO mg |
|---|---|---|---|
| D Measured | 7.0 | 2.17 | 36.1 |

EXAMPLE V

Cigarettes E were produced consisting of 24.75 mm circumference, 64 mm long cigarette rods and 20 mm long cellulose acetate filters. The density of the cut tabacco filler of the cigarette rods, which filler contained 12% by weight of DIET expanded tobacco, was 252 mg $cm^{-3}$. The cigarette rod wrappers of the Cigarettes E were of the same conventional cigarette paper as was used for the Cigarettes A of Example IV.

Cigarettes F were produced, which were the same in all particulars as the Cigarettes E except for the use in Cigarettes F of cigarette paper of 18 Coresta Units permeability and 47.4 g $m^{-2}$ substance and comprising 33.3% magnesium hydroxide, 5.3% calcium carbonate, 5.3% potassium acetate and 1.1% sodium acetate.

Cigarettes G were the same in all particulars as Cigarettes E excepting that Cigarettes G were of a circumference of 17 mm and the cut tobacco filler contained 40% by weight DIET expanded tobacco, the density of the filler being 224 g $cm^{-3}$.

Cigarettes H were the same as Cigarettes G in all particulars excepting that the cigarette rod wrappers of Cigarettes H were of the same sidestream reducing paper as that of Cigarettes F. Cigarettes H were cigarettes in accordance with the subject invention.

The Cigarettes E to H were smoked under standard machine smoking conditions and determinations were made of the total sidestream yields per cigarette of PMWNF, TNA and CO. The measured values are given in Table 2. The predicted values for Cigarettes H were calculated in the same fashion as is detailed above in respect of Cigarettes D.

It is to be observed to Table 2 that Cigarettes H in accordance with the subject invention exhibit synergistic reductions in sidestream PMWNF, TNA and CO. Cigarettes H also exhibited a synergistic reduction for sidestream carbon dioxide.

The average puff number of Cigarette H was 6.8.

TABLE 2

| Cigarette | PMWNF mg | TNA mg | CO mg |
|---|---|---|---|
| E | 25.6 | 5.45 | 58.6 |
| F | 11.8 | 3.79 | 51.5 |
| G | 14.6 | 2.40 | 30.4 |
| H | 6.7 | 1.68 | 26.7 |
| Predicted H Measured | 5.3 | 1.15 | 25.9 |

EXAMPLE VI

Cigarettes I were produced consisting of 24.75 mm circumference, 64 mm long cigarette rods and 20 mm long cellulose acetate filters. The density of the cut tobacco filler of the cigarette rods was 291 mg $cm^{-3}$. The cigarette rod wrappers of the Cigarettes I were of the same conventional cigarette paper as was used for the Cigarettes A of Example IV.

Cigarettes J were produced, which were the same in all particulars as the Cigarettes I except for the use in Cigarettes J of cigarette paper of 5 Coresta units permeability and 45.0 substance and comprising 16% Attapulgite clay, 18% calcium carbonate, 11% tripotassium citrate and 3% monoammonium phosphate.

Cigarettes K were the same in all particulars as Cigarettes I excepting that Cigarettes K were of a circumference of 17 mm.

Cigarettes L were the same as Cigarettes K in all particulars excepting that the cigarette rod wrappers of Cigarettes L were of the same sidestream reducing paper as that of Cigarettes J. Cigarettes L were cigarettes in accordance with the subject invention.

The Cigarettes I to L were smoked under standard machine smoking conditions and determination were made of the total sidestream yields per cigarette of PMWNF, TNA and CO, the values of which are given in Table 3.

It is to be observed of Table 3 that Cigarettes L in accordance with the subject invention exhibit synergistic reductions in sidestream TNA and CO.

The average puff number of Cigarettes L was 13.0.

TABLE 3

| Cigarette | PMWNF mg | TNA mg | CO mg |
|---|---|---|---|
| I | 33.7 | 4.9 | 67.0 |
| J | 13.5 | 2.7 | 49.0 |
| K | 18.5 | 3.29 | 42.4 |
| L | 7.4 | 1.81 | 31.0 |
| Predicted L Measured | 9.8 | 1.73 | 25.6 |

FIG. 1 of the diagrammatic drawings hereof shows apparatus used in making determinations of deliveries of sidestream smoke components and FIGS. 2 to 5 show a fishtail chimney forming part of the apparatus shown in FIG. 1, FIGS. 3 to 5 being views on FIG. 2 taken in the directions of arrows A, B and C respectively.

The apparatus shown in FIG. 1 which was used in making the determinations of the above cited deliveries of sidestream smoke components comprised a Filtrona 302 linear smoking machine 7, a port of which is designated by reference numeral 8. At each port of the smoking machine 7 there was vertically disposed an open ended, glass fishtail chimney, that associated with port 8 being designated by reference numeral 9. In FIG. 2 dimensions a and b are 410 mm and 80 mm respectively. In FIG. 3 internal dimension (diameter) c is 24 mm and dimension d is 22 mm. Transversely disposed above chimney 9 was a pre-weighed Cambridge filter pad 10. The item designated by reference numeral 10' is a Cambridge filter pad utilised in the measurement of mainstream smoke component deliveries. A tube 11 extended from the upper side of the filter pad 10 to a gas-flow meter 12, from which meter 12 a tube 13 extended to a gas pump 14. Connected to the pipe 13 by inlet and outlet tubes 15, 16 was an infrared carbon monoxide analyser 17 embodying an internal gas circulation pump (not shown).

In operation of the FIG. 1 apparatus, for the determination of sidestream smoke component deliveries of a cigarette 18 smoked at the port 8 of the smoking machine 7, the pump 14 was set to provide a flow rate through chimney 9, tube 11 and tube 13 of 2.0 liters per minutes. During the smoking of the cigarette 18 under standard smoking conditions at the port 8 the sidestream smoke emanating from the cigarette 18 passed up the chimney 9 to the filter pad 10. That portion of the smoke not deposited at the pad 10 or on the interior walls of the chimney 9 passed through tubes 11, 13 and a sub-sample thereof passed through the carbon monoxide analyser 17 by way of the inlet and outlet tubes 15, 16.

When the smoking at port 8 of the cigarette 18 and two identical cigarettes had been completed, the pad 10 was re-weighed. From the weight so determined there was substracted the original weight of the pad 10, thus to give the weight of total particulate matter (TPM) deposited on the pad 10. The pad 10 was then extracted with an extracting solvent, propan-2-ol for example. The extract so obtain was analysed by gas chromatography to determine the amounts of nicotine and water deposited on the pad 10. The sum of the weights so determined of nicotine and water was subtracted from the above mentioned gravimetrically determined weight of TPM deposited on the pad 10, thus to give the weight of PMWNF there deposited.

The interior of the chimney 9 was rinsed with an extracting solvent, propan-2-ol for example. A portion of the extract so obtained was analysed by gas chromatography to determine the amount of nicotine deposited on the interior walls of the chimney 9. The weight of nicotine so determined was added to the weight of nicotine deposited on the pad 10, thus to give the total weight of sidestream nicotine produced from the three cigarettes, which weight was divided by three to give the weight of sidestream nicotine per cigarette.

The other portion of the extract obtained from the rinsing of the chimney 9 was analysed by an ultra violet technique, in which as a standard was employed a portion of the above referred to extract obtained from the pad 10, to determine the amount of PMWNF deposited on the interior walls of the chimney 9. The weight of PMWNF so determined was added to the weight of PMWNF, as above determined, deposited on the pad 10, thus to give the total weight of sidestream PMWNF produced from the three cigarettes, which weight was divided by three to give the weight of sidestream PMWNF per cigarette.

The sidestream smoke CO yield per cigarette was determined from data obtained from the analyser 17.

We claim:

1. A finished cigarette in the form of an elongated rod of uniform cross-section throughout its length, said elongated rod consisting of:

a tobacco filler;

a cigarette paper wrapper; and a filter; said cigarette paper wrapper having:

a first cigarette paper circumscribing the tobacco filler, and a second cigarette paper overwrapping said first cigarette paper, said second cigarette paper having a g $m^{-2}$ basis weight different from that of said first cigarette paper and a Coresta unit permeability value different from that of said first cigarette paper, and said elongated rod having an outer circumference which is not less than 12.5 mm and not more than 20 mm.

2. The cigarette of claim 1 wherein the g $m^{-2}$ basis weight of said second cigarette paper is greater than that of said first cigarette paper.

3. The cigarette of claim 1 wherein said second cigarette paper contains solid filler material.

4. The cigarette of claim 1 wherein said tobacco filler has a packing density of 293 mg/cm$^2$.

5. The cigarette of claim 1 wherein said filter has a length of 27 mm.

6. The cigarette of claim 1 wherein said tobacco filler has a length of 70 mm.

7. The cigarette of claim 2, or 3 wherein said elongated rod has a circumference which does not exceed about 19 mm.

8. The cigarette of claim 2, or 3 wherein said elongated rod has a circumference which is less than 18 mm.

9. The cigarette of claim 2, or 3 wherein the circumference is 17 mm.

10. The cigarette of claim 13 wherein said solid filler material includes chalk.

11. A finished cigarette in the form of an elongated rod of uniform cross-section throughout its length, said elongated rod consisting of:

a tobacco filler;

a cigarette paper wrapper; and a filter;

said cigarette paper wrapper having:

a first cigarette paper circumscribing the tobacco filler, and a second cigarette paper overwrapping said first cigarette paper, said second cigarette paper having a g $m^{-2}$ basis weight different from that of said first cigarette paper and a Coresta unit permeability value different from that of said first cigarette paper, said second cigarette paper further containing solid filler material, wherein said solid filler material includes a member selected from the group consisting of chalk and magnesium hydroxide, and said elongated rod having an outer circumference which is not less than 12.5 mm and not more than 20 mm.

12. A finished cigarette in the form of an elongated rod of uniform cross-section throughout its length, said elongated rod consisting of:

a tobacco filler;

a cigarette paper wrapper; and a filter;

said cigarette paper wrapper having:

a first cigarette paper circumscribing the tobacco filler, and a second cigarette paper overwrapping said first cigarette paper, said second cigarette paper having g $m^{-2}$ basis weight different from that of said first cigarette paper and a Coresta unit permeability value different from that of said first cigarette paper, said second cigarette paper further containing solid filler material, wherein said solid filler material is present in an amount of about 29 percent by weight, and said elongated rod having an outer circumference which is not less than 12.5 mm and not more than 20 mm.

13. The cigarette of claim 11 wherein said solid filler material includes chalk and magnesium hydroxide.

14. The cigarette of claim 12 wherein said solid filler is present in an amount of 28.8 percent by weight.

15. The cigarette of claim 13 wherein said solid filler material comprises 4.5% chalk and 24.3% magnesium hydroxide, said rod is 70 mm long and 17 mm in circumference and said tobacco filler is packed at a density of 293 mg $cm^{-3}$, said finished cigarette upon smoking delivers a sidestream nicotine yield of 1.1 mg.

16. The cigarette of claim 15 wherein said finished cigarette upon smoking delivers a sidestream nicotine yield which is 22.5% of that of a cigarette having a conventional circumference of 24.75 mm conventionally wrapper.

* * * * *